US005769109A

United States Patent [19]

Stanton et al.

[11] Patent Number: 5,769,109

[45] Date of Patent: Jun. 23, 1998

[54] STORAGE VAULT WITH OVERFLOW CONTAINMENT COLLAR

[75] Inventors: Kelly Stanton, Schenectady, N.Y.; Laura Misiewicz-DelZotto, Ocala, Fla.

[73] Assignee: Guardian Containment Corp., Schenectady, N.Y.

[21] Appl. No.: 660,276

[22] Filed: Jun. 7, 1996

[51] Int. Cl.[6] ..... B65D 47/00

[52] U.S. Cl. ..... 137/264; 137/312; 220/501; 220/571

[58] Field of Search ..... 137/264, 312; 220/501, 571

[56] References Cited

U.S. PATENT DOCUMENTS

| | | | |
|---|---|---|---|
| 4,278,115 | 7/1981 | Briles et al. | 137/312 X |
| 4,520,852 | 6/1985 | Klein | 137/312 X |
| 4,762,440 | 8/1988 | Argandona | 137/312 X |
| 5,197,627 | 3/1993 | Disabato et al. | 220/571 |
| 5,381,923 | 1/1995 | O'Dea | 220/501 X |

*Primary Examiner*—Kevin Lee
*Attorney, Agent, or Firm*—D. L. Tschida

[57] ABSTRACT

An overflow containment system for metal or fiberglass liquid storage tanks mounted within a liquid impermeable, secondary storage space. An open-topped, reinforced cast concrete base includes an internal thermal liner, liquid impermeable membrane, vault seal, tank cradles and support legs which define secondary and tertiary containment spaces. Sloped interior walls direct liquid and/or condensation to a sump region and a siphon assembly. A vault cover is bonded to the tank and supports a number of projecting fill, vent, extraction, inspection, and monitor/siphon standpipes. Chamfered and flanged edges at the cover and lift hooks facilitate cover removal, alignment, and tank inspection. A spill containment collar is mounted about the fill pipe and a drain pipe directs spillage to the secondary storage space of the base.

14 Claims, 5 Drawing Sheets

STORAGE VAULT WITH OVERFLOW CONTAINMENT COLLAR

BACKGROUND OF THE INVENTION

The present invention relates to an above-grade multi-section cast concrete containment vessel which includes a primary liquid storage tank and an intervening liquid and thermal liners, which collectively define primary, secondary and tertiary storage spaces, and, in particular, to a spill containment assembly which directs spillage at the fill pipe to the secondary storage space.

A byproduct of society's increasing awareness to the environment and growing concerns toward ground water contamination and the adverse effects of spilled petrochemicals (e.g. oil, gasoline etc.) has been the institution of varieties of regulatory controls. The containment tank of the present invention was developed to accommodate such regulations, especially for circumstances requiring above-grade storage of gasoline. A further purpose was to accommodate concerns of the user to cost and repair or replacement of portions of the containment system. The configurations of the storage containers are directed to containing ruptures and not spillage.

A variety of predecessor, below-grade storage systems have been developed for containing pressurized and non-pressurized, flammable liquids, such as gasoline, propane or natural gas. Some of such containment vessels or tanks are shown at U.S. Pat. Nos. 1,958,487; 3,151,416; 3,995,472; 4,183,221; 4,607,522; and 4,653,312. The foregoing vessels generally provide tank constructions which include a primary metal containment chamber that is surrounded by a reinforcing material, such as concrete. Intervening layers of insulators and/or liquid impermeable materials are also disclosed in various storage arrangements.

Numerous above-grade storage vessels are also known. Most such vessels provide only a tank assembly having a single skin or layer of material, such as metal or concrete, which can be damaged and produce an uncontained spill.

To avoid spills, some tanks are diked behind a surrounding berm. Some tanks provide a multi-layered construction that includes a primary tank surrounded by a concrete or metal structure. The primary tank may or may not be integrated into the surrounding structure. U.S. Pat. Nos. 2,083,491; 2,136,390; 2,777,295; and 4,513,550 disclose cast concrete containment chambers wherein the structural walls include liquid impermeable liners.

Still other above-grade storage vessels are disclosed at U.S. Pat. Nos. 2,544,828; 3,562,977; 4,366,654; 4,372,906; 4,552,166; 4,826,644; 4,934,122; and 4,986,436. Various of the foregoing storage vessels provide a primary metal containment chamber which is surrounded by a monolithic cast concrete vault. One or more intervening membranes impermeable to a contained liquid are also provided.

Another metal storage vessel having secondary containment is shown at U.S. Pat. No. 4,895,272. Also included in the tank is an assembly for directing spillage from the vent into a secondary storage space.

A principal deficiency of the foregoing above-grade storage containers is that the primary tank is exposed to a variety of physical dangers which can affect the life of the container. The sealed concrete tanks are also subject to potential cracking with thermal expansion/contraction; physical damage due to handling or collision from automobiles, trucks, on-site equipment or the like; and potential corrosion of reinforcement members within the concrete, such as from condensates which form between the steel liner and surrounding concrete assembly. Damage to any one of the container components typically requires replacement of the entire assembly.

In preference to a monolithic assembly, a modular assembly permits selective replacement of one or more of the container components in the event of damage or normal wear and tear to the individual components. A modular construction is also more accommodating of conventional manufacturing processes, such as are used to form open top septic tanks and detachable covers.

In appreciation of the foregoing deficiencies, the present invention provides a liquid storage container, which lends itself to conventional pre-cast concrete construction technology. The vessel provides an improved, environmentally friendly containment structure for storing flammable liquids, such as gasoline, propane or the like. A spill containment collar is mounted to a file port and coupled to a secondary containment space to enhance the utility of the assembly and permits safe recovery of spillage without contamination.

SUMMARY OF THE INVENTION

It accordingly is a primary object of the present invention to provide an environmentally friendly, above-grade liquid containment vessel.

It is a further object of the invention to provide a vessel including a reinforced cast concrete base for containing a primary liquid storage tank and providing secondary and tertiary containment spaces.

It is a further object of the invention to provide a base having a liquid impermeable membrane to provide a leak barrier between the primary tank and base in the event of rupture of the primary storage tank and a thermal liner to minimize condensation.

It is a further object of the invention to provide a cast concrete base which may include cradles for supporting the primary storage tank, a separate cover, which may be secured to the primary tank at reinforcement members cast as part of the cover, and seals which surround the periphery of the seam between the cover and base and a number of standpipes which project through the cover.

It is a further object of the invention to provide a sump and one or more siphon assemblies that communicate with the interior space of the base to facilitate removal of condensate and the recovery of leakage or spillage.

It is a further object of the invention to provide a spill containment collar which mounts about fill and/or vent pipes from the primary storage tank to collect spillage and direct any spillage to a secondary storage space within the base or to an auxiliary or secondary storage tank.

It is a still further object of the invention to provide a secondary or auxiliary storage tank which mounts adjacent the base and is coupled to the spill collar to collect spillage.

It is a still further object of the invention to provide liquid monitoring within the storage tank, between the tank and liner and between the impermeable liner and vault walls.

Various of the foregoing objects, advantages and distinctions of the invention are obtained in a presently preferred construction which provides an open-topped, reinforced cast concrete base and a removable, separately cast cover and tank assembly. The cover supports an integrally cast, primary liquid storage tank. The base and cover are lined with a thermal barrier. The thermal barrier of the base is separately covered with a liquid impermeable membrane. A sump region at a low point of the base and a siphon assembly are provided which communicate with the interior spaces between the tank and liner and the liner and vault. The base may include internal tank cradles or the cradles may be secured to the primary tank.

The cover is integrally cast to common reinforcement members which project from either a metal or fiberglass primary storage tank that mounts within the vault. The tank and cover are integrated to self-align to the base. The base, cover and/or tank are separately replaceable. Chamfered cover edges and lifting eyelets, which are secured to the tank and project from the cover, facilitate removal or replacement of the tank and cover.

A seal mounts between the base and cover. Separate resilient seals are cast into the cover and surround a number of standpipes which project from the primary tank. Ones of the standpipes permit filling and vent the primary tank. Others permit monitoring the stored liquid and inspection of the secondary and tertiary spaces.

The interior walls of the base are sloped to relieve stresses encountered in climates exposed to potential freezing conditions and direct collected leakage, spillage or condensate to the sump space. Siphon assemblies remove condensate, leakage or spillage. Support legs extend from the base to facilitate vault handling. Skirts may be mounted to the vault legs, once the container is located at the storage site.

A spill collar is fitted to the fill pipe and/or vent pipe to collect spillage that may occur during filling or with liquid expansion. The collar provides a covered housing which mounts about the standpipes. Conduits direct collected spillage to the secondary containment space within the base or to an auxiliary collection tank.

Still other objects, advantages and distinctions of the invention will become more apparent upon reference to the following detailed description with respect to the appended drawings. To the extent various modifications and improvements have been considered, they are described as appropriate. The invention should not however be interpreted in strict limitation to the provided description. Rather, the invention should be interpreted within the spirit and scope of the appended claims.

DESCRIPTION OF THE PREFERRED EMBODIMENT

Figure 1:
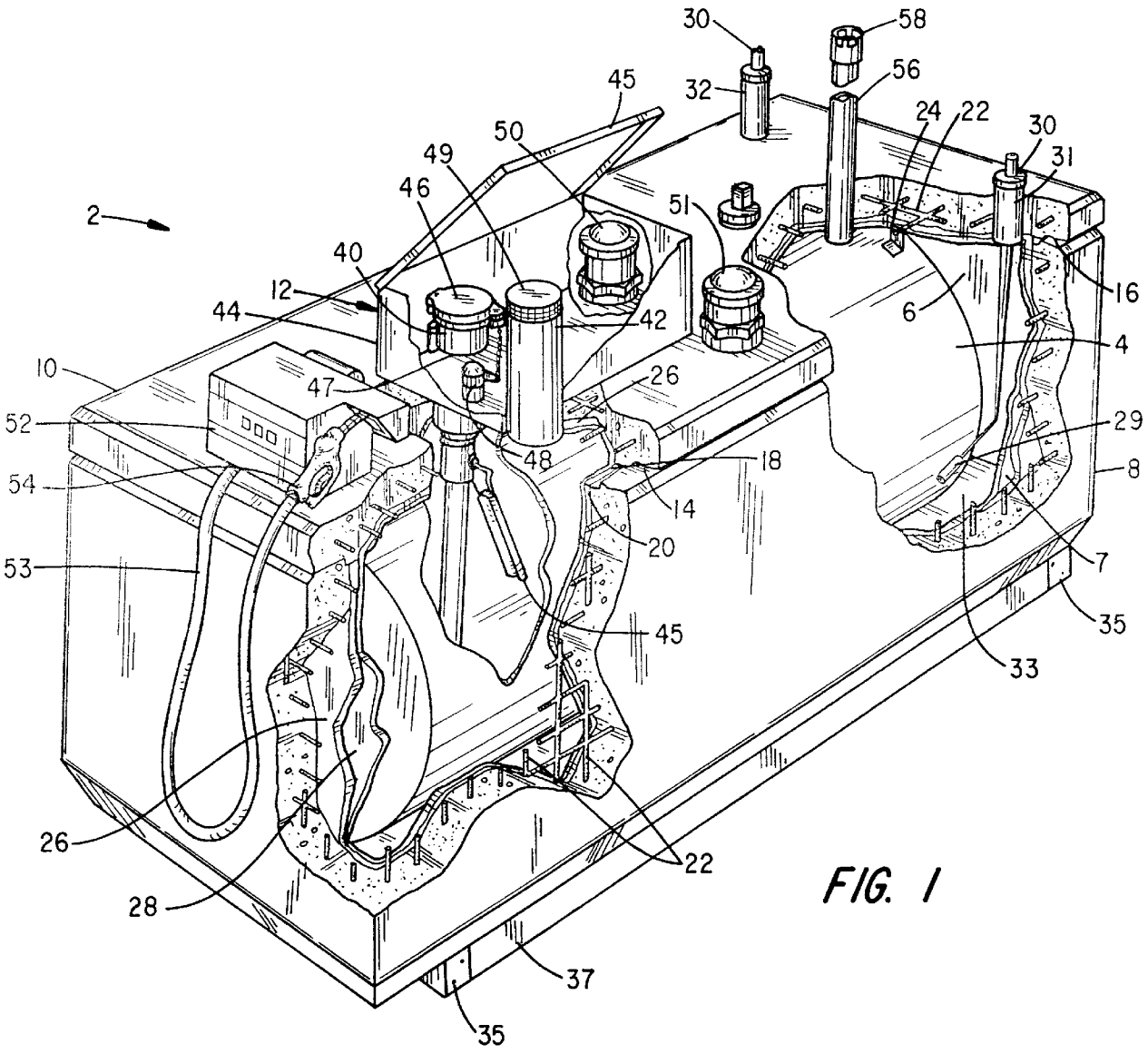
FIG. 1 is a perspective drawing shown in partial cutaway to an overflow or spill containment collar at a double walled storage tank.

Referring to FIG. 1, a perspective drawing is shown to a multi-section, liquid storage container or vault 2 which includes a primary containment tank 4. Secondary and tertiary containment of leaks, spills or condensation is obtained in cavity spaces 6 and 7 between the tank 4 and the walls of a surrounding cast concrete base 8.

Figure 5:
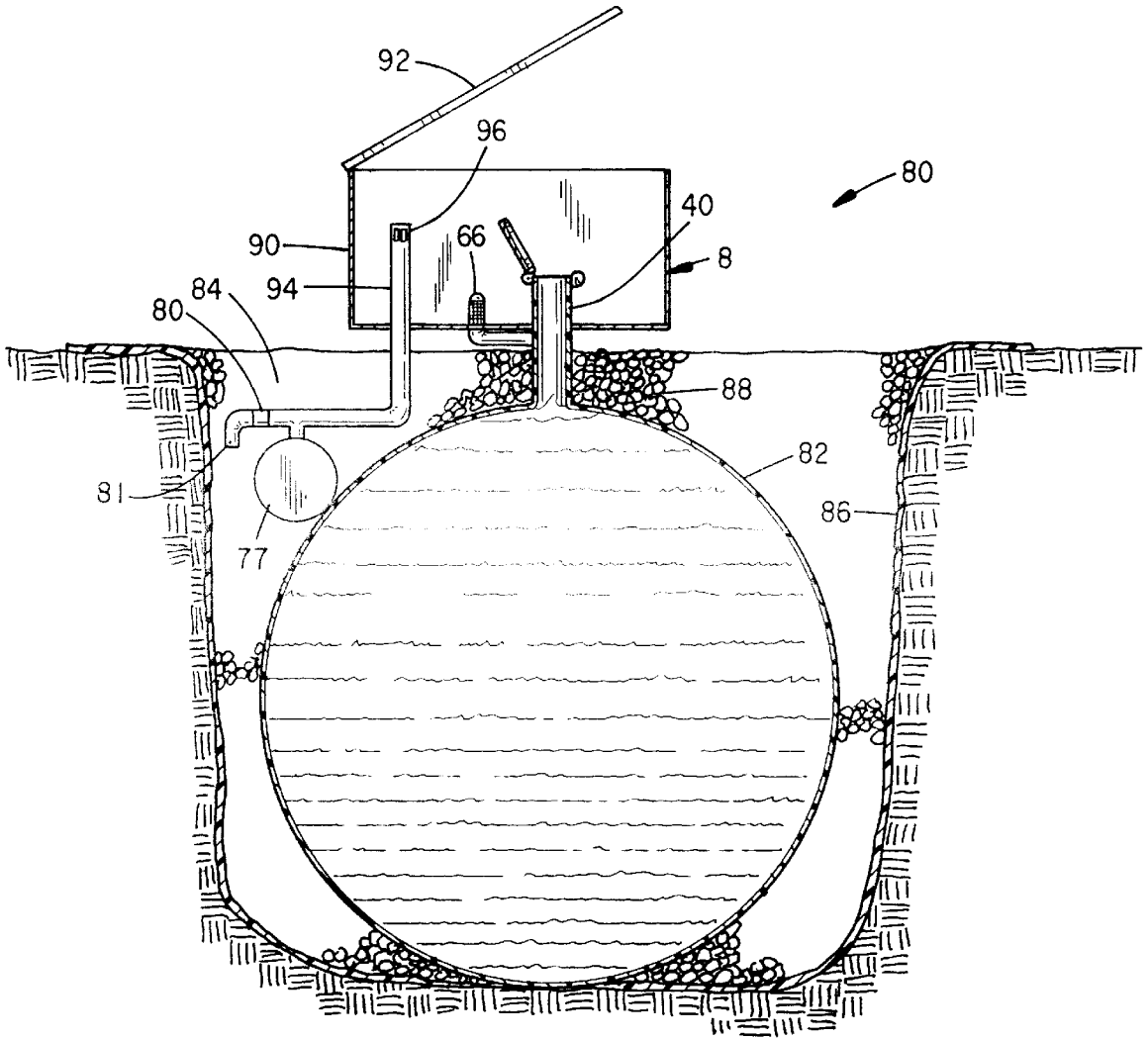
FIG. 5 is a cross section view through a below ground tank fitted with a spill collection collar that directs spillage to a lined and aggregate filled secondary collection space.

The container 2 is constructed to mount above-grade, although might be bermed behind surrounding earthen walls or be buried in a partial or complete below-grade trench. FIG. 5 depicts a primary tank 4 that is mounted in a below-grade, aggregate filled trench. The primary storage tank 4 can be constructed of metal or fiberglass.

The base 8 provides an open top and a cover 10. The base 8 is typically sized to contain a volume of approximately 120% to 150% of the volume of primary tank 4. Presently, the base 8 is sized to contain 125% of the storage capacity of the primary tank 4. The secondary storage space 6 of the base 8 collects and contains leakage that might occur from a rupture of the primary tank 4 or condensation that might collect on the tank 4.

Spillage, which can result from over filling the tank 4 or from expansion of the contained liquid, is also collected and contained by the secondary space 6. A spill collar assembly 12, which is discussed in more detail at FIGS. 2 through 5, also directs spillage to the space 6. Spill containment is possible due to the excess capacity provided by the base 8 beyond the contents of the tank 4. The secondary space 6 is also redundantly protected by a tertiary containment space 7 between the walls of the base 8 and a liquid impermeable liner that is also discussed below.

The cover 10 is sealed to the upper peripheral edge of the base 8 with a resilient, compressible fire stop barrier material 14 and sealant 16. Mating flanged surfaces 18 and 20 are formed into the cover 10 and base 8 to overlap and align with one another and interlock the cover 10 to the base 8. The mechanical integrity of the container 2 is thereby preserved in the event lateral forces directed against the base 8, such as from a vehicle striking the base 8. The cover is also securely retained to the base 8.

Cast into the walls of the base 8 and cover 10 in conventional fashion are reinforcement members 22, which typically comprise lengths of rebar, wire mesh or the like. The reinforcement members 22 of the cover 10 are woven and interconnected to bored appendages 24 which extend from the primary tank 4. The cover 10 and primary tank 4 are thereby constructed as a single assembly having a predetermined alignment to the base 8. Details to the later construction are described at applicant's U.S. Pat. No. 5,285,914. The cover 10 might also be constructed to separate from the tank 4.

Mounted to the interior surfaces of the container 2 is a thermal insulator or liner 26. Sheets of foam are presently bonded with a suitable adhesive to the concrete walls and floor of the base 8 and to the cover 10. The thermal barrier 26 reduces potential moisture and condensation which can occur within the base 8.

Covering the thermal barrier 26 is a continuous layer of a liquid impermeable sheathing 28 which is folded to closely fit to the foam liner 26 and extend over the upper edges of the base 8 and beneath the fire stop 14. The sheathing 28 is bonded to the upper edges of the base 8 with an adhesive sealant 16 that is impervious to any stored liquids (e.g. PENSIL 300). The sheathing 28 defines the interface between the secondary and tertiary storage spaces 6 and 7.

Bonded, in turn, to the upper surface of the sheathing 28 is the fire stop 14. A bead of sealant 16 is applied to the barrier 14 prior to fitting the cover 10 and tank 4 to the base 8. A further bead of sealant 16 is provided between the cover 10 and base 8 to seal the spaces 6 and 7 and obtain a liquid and gas tight interior.

In the event of a rupture of the primary tank 4, spilled liquid is normally retained within the base 8 at the secondary containment space 6 between the tank 4 and liner 28. In the event of a rupture of the liner 28, the spillage is captured by the walls of the base 8 in the tertiary containment space 7.

A conventional leak monitoring assembly 30 projects from the cover 10 at a standpipe 31 into the secondary space 6 to monitor possible leaks or spillage as discussed below. Similarly, a monitor 30 is fitted to a standpipe 32 to monitor liquid in the tertiary space 7 between the liner 28 and walls of the base 4. A float 29 is presently coupled to the monitor 30 at the stand pipe 31. A variety of conventional monitoring assemblies, however, can be used to monitor internal liquid levels and which may include a variety of liquid sensing transducers. A single monitoring assembly 30 can be used, or none, depending upon the application and regulatory requirements.

The stand pipes 31 and 32 may also be used as visual inspection ports. That is, an operator can periodically illuminate and look into the interior of the base 4 from the pipes 31, 32. A simple dipstick (not shown) may also be inserted through the pipes to monitor for the presence of liquid.

A sump region 33 or low point of the bottom wall is formed in the region beneath the pipes 31 and 32 to collect leakage and spillage. The bottom wall of the base 8 is sloped to direct the liquid to the sump 33. A conventional siphon or pump assembly may be fitted in conventional fashion to the pipes 31 and 32 as required to extract liquids that collect in the spaces 6 and 7.

Legs 35 support the base 8 above the ground and permit the lifting of the vault 2 by a crane or other appropriate equipment. Once set to a preferred site, the legs 35 are enclosed by skirts 37. Debris and other materials are thereby prevented from collecting beneath the base 8.

The spill collar 12 equips the vault 2 to contain possible spillage which might occur during the filling of the tank 4. Spillage can occur under either "loose fill" or "tight fill" conditions. A "loose fill" condition exists where a fill nozzle is loosely supported (i.e. not threaded) to the fill pipe 40, reference FIG. 2. A "tight fill" condition exits where the fill nozzle is threaded to the fill pipe 40, reference FIGS. 3 and 4.

Mounted within the spill collar 12 is a fill pipe 40 and an overflow pipe 42. The pipes 40 and 42 are contained by an overflow housing 44, which has a loose fitting cover 45. A conventional overspill cover 46 is mounted to the fill pipe 40. Also contained within the housing 44 is a drain valve 48 which is coupled to the fill pipe 40. A check valve 43 is separately fitted to the fill pipe 40 and prevents back flow from the tank through the fill pipe 40. Some tanks 4 may not include a check valve 43 and for which condition the spill collar has been adapted at FIG. 3.

Resilient seals 47 are mounted between the housing 44 and the pipes 40, 42 and 46 to contain any overflow or spillage to the housing 44 and direct the overflow through an open mesh cover 49 at the overflow pipe 42. The pipe 42 preferably opens to the secondary containment space 6. The pipe 42 might also open to the tertiary space 7 or to an auxiliary storage space or tank, reference FIG. 4.

Supported also to the cover 10 is a variety of auxiliary equipment and redundant systems to support the use and maintain the integrity of the container 2. An emergency vent pipe 50, which vents the tank 4 and which is shown in cutaway, is mounted adjacent the overflow housing 44. An inspection manhole 51 permits inspection of the secondary space 6. A metered pump assembly 52 having a hose 53 and a dispensing nozzle 54 is fitted to an extraction pipe (not shown) that communicates with the interior of the tank 4. A vent pipe 56 having a ball float, check valve 58 also projects to vent the tank 4.

Under nominal overflow conditions, overflow or spillage, e.g. less than 2.5 gallons, is directed into the primary tank 4 from the fill pipe collar 46 or from the drain 48. Both capture and direct the liquid into the tank 4 via the fill pipe 40 or a bypass conduit that extends from the collar 46 and opens to the tank 4. If the volume of spillage or overflow exceeds the capacity of the tank 4, the additional liquid is directed to the secondary containment space 6 via the overflow pipe 42 and from which the spillage can be reclaimed. Overflow conditions can occur for a variety of reasons, for example, fill operator inattention or defective fill equipment.

Figure 2:
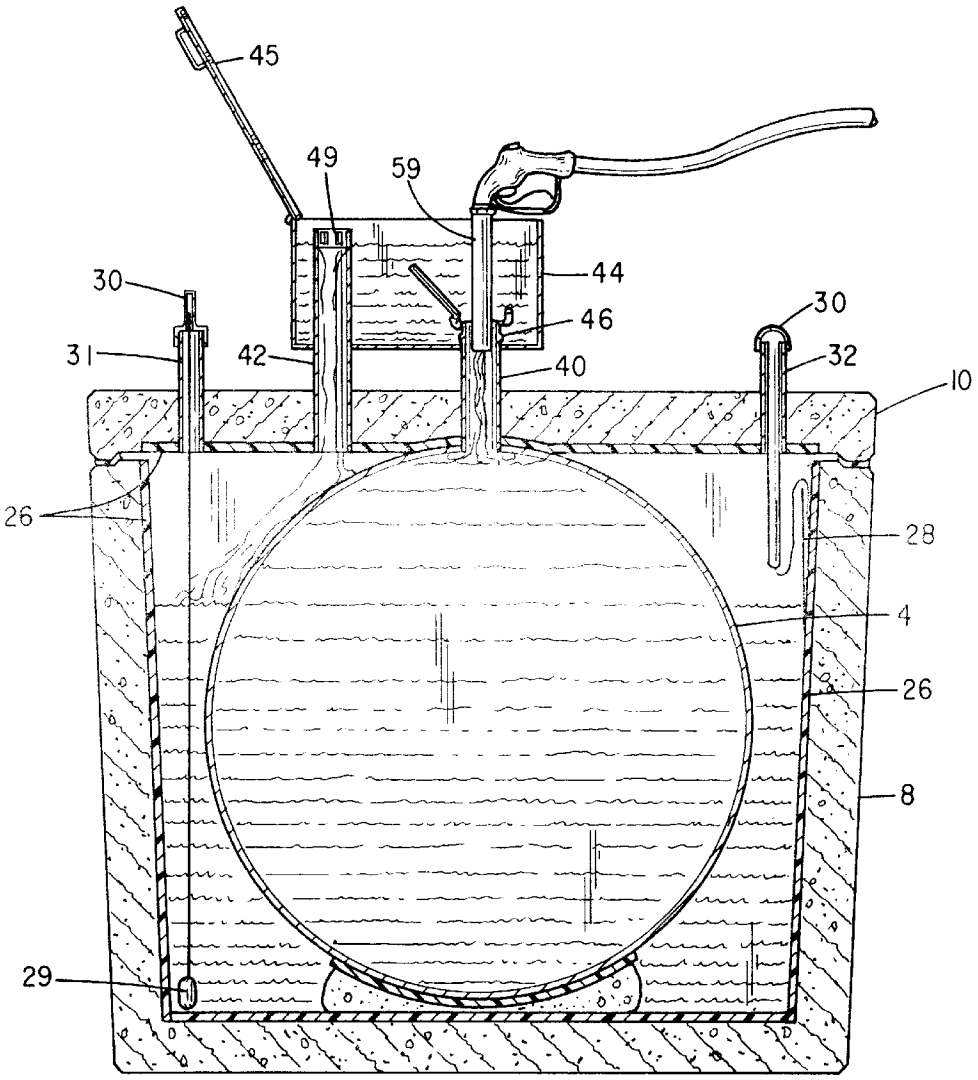
FIG. 2 is a cross section view through a spill collar at a fill pipe of a storage tank having secondary and tertiary containment.

With additional attention to FIG. 2, the spill collar 12 is shown as it appears when correcting a loose fill spill and in which instance a fill nozzle 59 is loosely supported to the fill pipe 40. With the fill nozzle 59 becoming dislodged from the pipe 40 or with filling of the tank 4 beyond capacity and which overcomes the drain 48, the overflowing liquid (e.g. in excess of 20 gallons) rises in the housing 44 to the level of the cover 49. The spilled liquid is then directed by the pipe 42 into the secondary storage space 6, where it collects and can be reclaimed. The amount of permitted overflow is controlled by the size of the housing 44 and the height of the cover 49.

Figure 3:
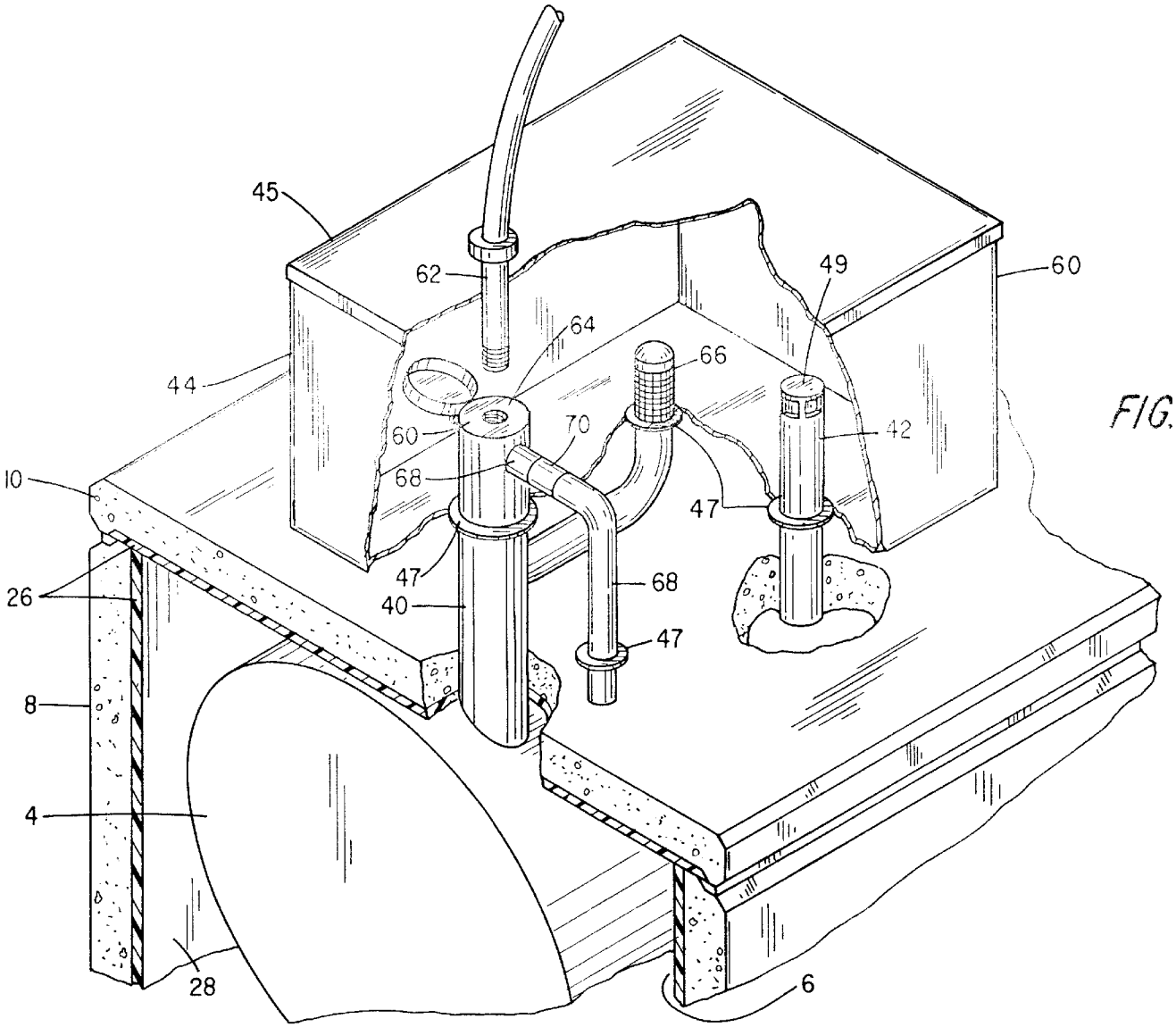
FIG. 3 is a cross section view through a spill collar at a vented fill pipe of a storage tank having secondary containment.

FIG. 3, in turn, depicts a spill collar 60 under a tight fill condition and for a fill pipe 40 that is not fitted with a check valve 43. A threaded fill nozzle 62 from a tanker truck (not shown) is secured to a mating coupler 64 at the fill pipe 40 and fuel is pumped through the nozzle 62 into the tank 4. With the filling of the tank 4 beyond capacity, such that the liquid flows from the covered drain port 66, liquid rises in the housing 44 to the level of the cover 49 which again directs the liquid into the secondary storage space 6.

Depending upon the overflow spill rate, additional flow is directed into the secondary storage space 6 via a bypass conduit 68 and relief valve 70 which are fitted to the fill pipe 40. That is, with the backup of the liquid in the fill pipe 40 to the level of the relief valve 70, liquid is directed through the relief valve 70 and conduit 68 into the space 6.

Figure 4:
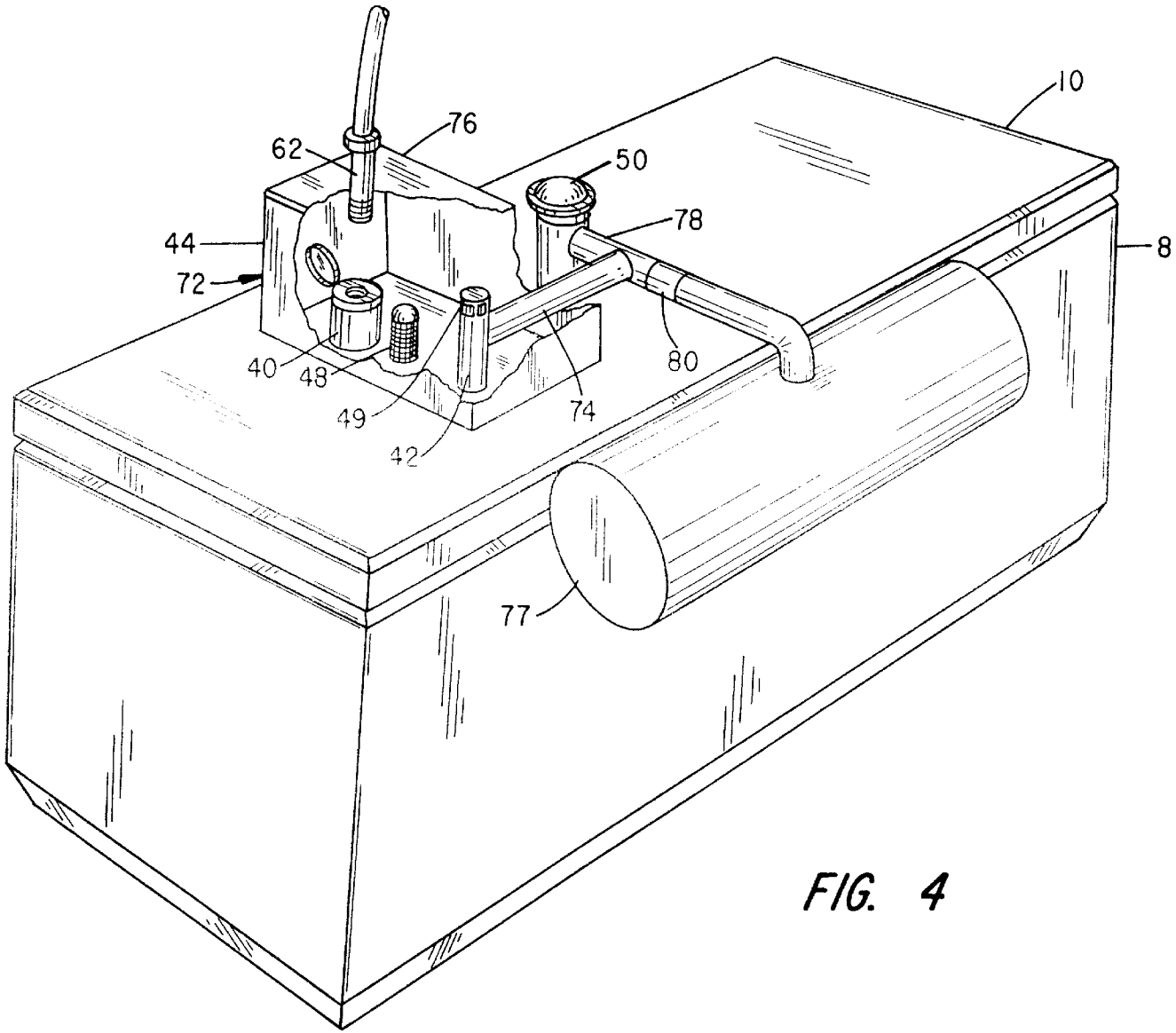
FIG. 4 is a cutaway view through a spill collar at a vented fill pipe of a storage tank having secondary containment which communicates with a cross-over conduit from the emergency vent pipe and an adjacent auxiliary spill collection tank.

FIG. 4 depicts another tight fill spill condition at a spill collar 72. As the liquid backs up from the tank 4 into the emergency vent 50, the liquid is directed through a sealed conduit 74 that mounts through the side of the housing 76 and to the overfill pipe 42 and the secondary storage space 6. Also shown is an alternative coupling of the overflow to an auxiliary tank 77 via a bypass conduit 78 and relief valve 80. Under normal circumstances, the relief valve 70 is set to open when the secondary storage space 6 is filled.

It is to be appreciated the tank 77 can be supported to the vault 2 or be displaced from the vault 2 at a suitable location. The conduit 78, fittings and tank 77 would be selected to achieve a desired auxiliary containment. It is also to be appreciated that an auxiliary tank 77 can be coupled to the overfill pipe 42 at FIGS. 1 and 2. Spills in excess of the 25% to 50% overcapacity of the vault 2 can thereby be accommodated and reclaimed without undue effort.

FIG. 5 lastly depicts a below-grade or diked storage system 80 wherein a primary tank 82, which is constructed of metal or fiberglass, is buried below grade in a trench space 84. The trench space 84 is lined with a liquid impermeable membrane 86. A pea gravel or other granular aggregate 88 is filled between the tank 82 and membrane 86. An overflow collar 89 having a housing 90 and cover 92 is fitted to the fill pipe 40 of the tank 82. An overflow pipe 94 depends from the housing 90 and couples to an auxiliary tank 77. A separate relief valve 80 and pipe 81 are mounted to direct overflow from the tank 77 into the aggregate 88. Overflow beyond minor spillage, which is contained by a drain port 66, is directed by the pipe 94 into the tank 77 where it can collect and be reclaimed. If the spill is greater than the capacity of either the housing 90 and tank 77, the spill is directed into the aggregate 88, where it is contained by the membrane 86. In lieu of the depicted mounting, the tank 77 can be mounted to the emergency vent pipe of the tank 82 in a fashion similar to FIG. 4. The spill pipe 94 may also be directed directly into the aggregate 88.

While the invention has been described with respect to a presently preferred construction and various considered modifications and improvements thereto, still other constructions may be suggested to those skilled in the art. The invention should be broadly construed within the spirit and scope of the appended claims.

What is claimed is:

1. Liquid containment apparatus comprising:

(a) a base having a plurality of sidewalls that project from a bottom wall to define an open cavity;

(b) tank means mounted within said open cavity for containing a liquid within a primary storage space;

(c) a liquid impermeable membrane mounted to encompass said tank means and terminating at a peripheral edge of said sidewalls, which membrane defines a secondary storage space in said open cavity that surrounds said tank means;

(d) a cast cover which mounts to said sidewalls to cover the open cavity and wherein a fill pipe extends through said cover and communicates with the primary storage space; and (e) spill containment means including a housing mounted to surround said fill pipe for capturing spillage from said fill pipe and directing the spillage into said secondary storage space whereby tank leakage or spillage from filling or backup from the primary storage space is contained within the secondary storage space.

2. Apparatus as set forth in claim 1 wherein said tank means comprises an enclosed container having a plurality of standpipes that extend from the container, and wherein said cover includes seal means for sealing a juncture between each of the standpipes that project from said cover and for sealing a juncture between said cover and said base.

3. Apparatus as set forth in claim 2 wherein surfaces of said sidewalls beneath said impermeable membrane are covered with a thermal insulation, and wherein the space between said membrane and the sidewalls defines a tertiary storage space.

4. Apparatus as set forth in claim 1 wherein the housing of said spill containment means encompasses an exposed aperture of an overflow pipe that communicates with said secondary storage space whereby liquid entering the exposed aperture is directed into said secondary storage space.

5. Apparatus as set forth in claim 4 wherein said tank means includes a vent pipe that is exposed to the atmosphere, and wherein said vent pipe is coupled to the secondary storage space.

6. Apparatus as set forth in claim 4 including an auxiliary storage tank coupled to said overflow pipe.

7. Apparatus as set forth in claim 6 including relief means for preventing flow of spillage to said auxiliary storage tank until said secondary storage space is filled.

8. Apparatus as set forth in claim 4 including means for monitoring liquid which collects in said secondary storage space.

9. Apparatus as set forth in claim 4 wherein said base includes a plurality of external feet that support said base above a support surface and further includes means for enclosing an exposed space between the base and support surface.

10. Apparatus as set forth in claim 4 wherein said cover includes reinforcement means for maintaining the rigidity of said cover, wherein said tank means includes attachment means for making a permanent coupling to said tank means, and wherein said reinforcement means is coupled to said attachment means and cast into said cover such that said cover and tank means are permanently bound to one another.

11. Liquid containment apparatus comprising:

(a) a liquid storage container having a concrete base comprised of i) a bottom wall, ii) a plurality of sidewalls that project from the bottom wall to define an open cavity, and iii) a cover that mounts to the sidewalls wherein an enclosed tank means is mounted within said open cavity for containing a liquid within a primary storage space, wherein a fill pipe having a fill collar communicates with the primary storage space and extends from the tank means through said cover, and wherein a liquid impermeable membrane i) is mounted to surround said tank means and secured said sidewalls to define a secondary storage space within the base around the tank means; and (b) spill containment means including a housing mounted to surround said fill pipe and fill collar, wherein the fill collar directs spillage less than a predetermined amount into said fill pipe, and wherein an overflow pipe is coupled to the secondary storage space and has an exposed aperture positioned within the housing, whereby tank leakage or spillage from filling or backup from the primary storage space is contained within the secondary storage space.

12. Apparatus as set forth in claim 11 wherein said tap means includes a vent pipe that is exposed to the atmosphere and wherein said vent pipe is coupled to said overflow pipe.

13. Apparatus as set forth in claim 11 including an auxiliary storage tank coupled to said overflow pipe.

14. Apparatus as set forth in claim 13 including relief means for preventing flow of spillage to said auxiliary storage tank until said secondary storage space is filled.

* * * * *